US005971598A

United States Patent [19]

Baba et al.

[11] Patent Number: 5,971,598

[45] **Date of Patent: *Oct. 26, 1999**

[54] WIRELESS REMOTE CONTROLLED TANNING SYSTEM

[75] Inventors: Robert Jay Baba, Garland; Roger Allen Brown, Dallas, both of Tex.

[73] Assignee: Puretan International, Inc., Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/662,782

[22] Filed: Jun. 7, 1996

[51] Int. Cl.[6] ..... H05B 37/02

[52] U.S. Cl. ..... 364/528.31; 364/132; 364/138; 702/62; 702/79; 702/134; 702/177; 340/310.06; 315/360; 315/149; 250/372; 250/493.1; 250/494.1

[58] Field of Search ..... 340/310.01, 310.02, 340/870.01–870.03, 870.1, 870.16, 870.18, 870.39, 870.41, 642, 825.06, 825.07, 825.62, 825.69, 825.17, 825.72, 310.06, 825.05; 364/480, 481, 483, 492, 493, 569, 550, 551.01, 132, 138, 139, 141, 143, 146, 413.01, 413.02, 413.04, 528.3, 528.31, 528.32, 528.41; 250/504 R, 494.1, 493.1, 372; 362/411, 84, 85, 233; 607/94, 91; 368/10; 315/360, 149; 377/16, 2; 702/57, 60, 62, 65, 79, 132, 134, 139, 140, 176, 178, 187, 188

[56] References Cited

U.S. PATENT DOCUMENTS

| | | | |
|---|---|---|---|
| 4,980,900 | 12/1990 | Welton | 377/16 |
| 5,268,666 | 12/1993 | Michel et al. | 340/310.02 |
| 5,374,825 | 12/1994 | Doty et al. | 250/372 |
| 5,400,246 | 3/1995 | Wilson et al. | 364/146 |
| 5,491,463 | 2/1996 | Sargeant et al. | 340/310.01 |
| 5,495,406 | 2/1996 | Kushiro et al. | 340/310.01 |
| 5,576,700 | 11/1996 | Davis et al. | 340/870.02 |
| 5,614,811 | 3/1997 | Sagalovich et al. | 340/310.06 |
| 5,684,826 | 11/1997 | Ratner | 340/310.01 |
| 5,725,565 | 3/1998 | Smith | 368/10 |

OTHER PUBLICATIONS

Brochure, Installation–Operating Instructions, "RMD 2—Remote Digital Timer", by *Asterick, Inc., 3 sheets, (No date).

*Primary Examiner*—Hal Dodge Wachsman
*Attorney, Agent, or Firm*—Sidley & Austin

[57] ABSTRACT

A tanning system (14) is disclosed which allows a single centrally located control unit (10) to control a number of remote tanning beds. Each tanning bed is provided with a remote unit (12) associated with the tanning bed. Communication occurs between the control unit (10) and the remote unit (12) through a common AC power wiring structure (22) extending therebetween. The system can use CEBus, X10 or another suitable system for communicating through the AC wiring structure. The operator has control of the operating time of each tanning bed while the customer has control of when the tanning operation begins.

1 Claim, 3 Drawing Sheets

WIRELESS REMOTE CONTROLLED TANNING SYSTEM

TECHNICAL FIELD OF THE INVENTION

This invention is directed generally to a remote controlled system of one or more tanning beds. Specifically, this invention relates to a system for controlling one or more remote tanning beds from a central location without the need for dedicated wiring. In one aspect, this invention relates to a two-way radio frequency controlled system for controlling one or more remotely located tanning beds from a central location using a facility's existing electrical wiring.

BACKGROUND OF THE INVENTION

Tanning beds are widely known in the industry and are used by people to tan themselves in a rapid manner without the need to be outside or to be exposed to direct sunlight. Tanning beds are usually located in a commercial location with multiple beds in one building. The plurality of beds are usually spaced throughout the building, each in a separate room, to offer the customer a private, relaxing and peaceful atmosphere.

Conventional tanning bed systems such as the "RMD 2" by *Asterisk, Inc. allow the remote control of a plurality of tanning beds from a central location. A central control unit is capable of activating or deactivating any one of a plurality of tanning beds from one central remote location. The central control unit can also put any one tanning bed into a delay mode. The "delay period" is a preset amount of time that a customer has before the actual tanning time starts. This delay period is used to allow a customer to disrobe and prepare for tanning. The central control unit is also capable of pausing any individual tanning bed, which deactivates the tanning bed, but permits reactivation without any loss of tanning time.

A display unit is capable of indicating whether a tanning session is in progress (i.e., a tanning bed is activated), whether a tanning bed is in a "delay period", or whether a tanning bed is not activated. The display unit is also located at the central location to allow the tanning system operator to monitor the events occurring in the tanning system and control the system accordingly.

Conventional tanning systems, however, have many shortcomings with regard to the ease and cost of installation and expansion of the system, the efficiency of operating the tanning system, and the safety of the customer(s).

Tanning systems known in the art require the existence of dedicated wiring. This dedicated wiring is required from the central control unit to each of the plurality of tanning beds. This dedicated wiring is expensive and must be added to facilities or buildings before a remote tanning system can be implemented. Furthermore, once the dedicated wiring is installed, the tanning system cannot be changed or enlarged without the need to re-wire the dedicated wiring. For example, if a tanning system provider decided to add a tanning bed in another room, that provider must run dedicated wiring from the central control unit to the new room. Moreover, if the tanning system provider was to move one tanning bed from one room to another, the new room would require new wiring. The need for dedicated wiring can severely limit the ability of a tanning system provider to grow or modify his current tanning system.

Another shortcoming of conventional tanning systems is their inability to efficiently manage and control the occupancy of the tanning system. One of the desires of tanning system providers is to maximize the amount of time that the tanning beds are occupied, which means the amount of time that a tanning bed is not in use (i.e., for cleaning or operator's failure to recognize a tanning bed's availability) must be minimized. Conventional systems have no way to alert an operator as to the availability of a tanning bed or the cleanliness status of a bed.

Furthermore, conventional tanning systems do not have the ability to determine if a tanning bed within the tanning system is not functioning properly. This presents a problem to customers who may be placed in a tanning bed that, for example, has a lamp that is not working properly.

SUMMARY OF THE INVENTION

The present invention is a new and advantageous wireless remote controlled tanning system for controlling and managing one or more remotely located tanning beds without the need for dedicated wiring.

As the number of beds (and rooms) under the control of one person or entity increases, so does the need for a central management and control system. The need for a central management and control system stemmed from the desire to offer the maximum amount of safety to the customer and to operate the tanning bed system at a maximum efficiency.

For safety reasons, the wireless remote controlled tanning system of the present invention is capable of monitoring the individual tanning beds to ensure they are functioning properly (i.e., the lamps of a particular tanning bed are working) and that the tanning beds do not present a danger to the customer. Furthermore, the present invention limits the customer to a predetermined amount of tanning time. This predetermined amount of tanning time can be set to range up to a maximum amount of tanning time set by the tanning bed provider to correspond to a particular value or government regulation. This feature ensures that the customer does not exceed the tanning time limit and possibly burn him or herself. Furthermore, the present invention provides a "pause all" feature which deactivates all of the tanning beds in the system and allows for reactivation of the system without any loss in the paid for tanning time of any of the customers. The pause all feature permits the tanning system operator to halt the system in case of an emergency, or in order to provide announcements to all of the customers in the entire tanning system.

For efficiency reasons, the present invention minimizes the amount of "down time" of the tanning system. By indicating the cleanliness status of a tanning bed, whether a tanning bed is occupied, whether a tanning bed is unoccupied and when the amount of tanning time remaining in a particular tanning bed is at less than five minutes (or any other predetermined time). The aforementioned features allow the tanning system operator to more efficiently schedule the cleaning and occupancy of the tanning beds within the tanning system.

DETAILED DESCRIPTION

Figure 1:
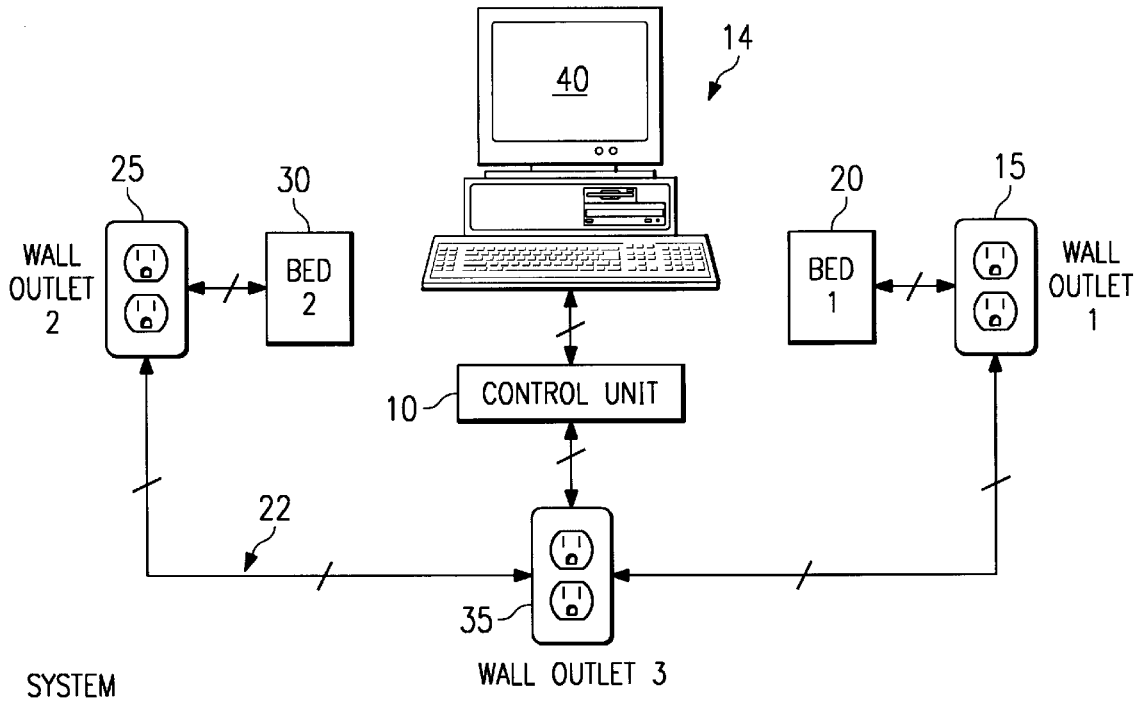
FIG. 1 is a block diagram illustrating a preferred embodiment of a wireless remote controlled tanning system utilizing existing AC power wiring.
Figure 2:
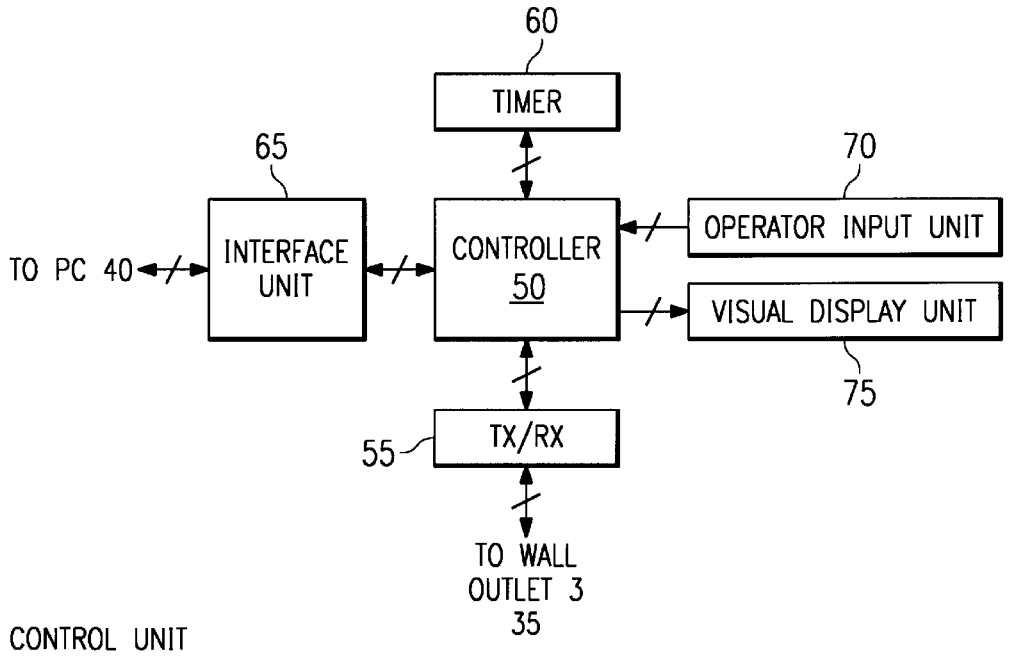
FIG. 2 is a block diagram illustrating the control unit in the preferred embodiment of FIG. 1.

FIG. 1 illustrates a preferred embodiment of a wireless remote controlled tanning system 14 utilizing existing AC power wiring in accordance with the present invention. This embodiment includes a conventional alternating current ("AC") power source and wiring structure which terminates in various areas throughout the system. The terminations of the AC power source and wiring system are well known in the art and are known as wall outlets. This embodiment further includes a control unit 10 which can be located in a central room or area. The control unit 10 is electrically coupled to a first wall outlet 35. This connection between the control unit 10 and the first wall outlet 35 can be made using conventional means, such as a power cord, but is not limited to such connecting means. The present invention contemplates at least one tanning bed. The embodiment depicted in FIG. 1 of the present includes multiple tanning beds 20 and 30. Each of tanning beds 20 and 30 is connected to its own wall outlet 15 and 25, respectively.

On each of the tanning beds 20 and 30 is mounted a remote unit 12. As described in greater detail hereinafter, communication occurs between the single control unit 10 and the multiple remote units 12 through the a/c wiring structure 22. Preferably, the communication takes place through the Consumer Electronics Bus (CEBus) Standard, the X10 technology or other similar technology for transmitting data and instructions over an a/c wiring system.

The control unit 10 can also have a personal computer (pc) incorporated therein or be connected to a stand-alone PC 40 connected to the control unit through a standard RS232 control port.

In operation, the control unit 10 will generally be located at the front desk of the tanning salon. The operator can control and monitor each of the tanning beds in the salon, even though the tanning beds are in separate rooms and located remotely from the operator through the communication and interaction of the control unit and plural remote units 12.

By using a wireless control tanning system 14, a number of advantages are realized over prior hardwired systems. Because the communications take place over a standard a/c wiring structure 22, the tanning salon can be moved into a pre-existing construction without special adaptations or wiring installations to adapt the space for the tanning salon. In addition, even when the space is intended for use by a tanning salon, the wireless tanning system 14 allows for easy addition of new beds in a room or area which need only have a conventional a/c wiring structure 22 therein. This results in a significant reduction of installation and re-installation costs and time. No separate 24-volt dedicated wiring system is necessary from each of the tanning beds to a central location. Because all operations are controlled from the single control unit 10, removal of this unit for security purposes will deactivate the entire system. Also, since the control unit is not hardwired to a single location, the control unit 10, itself, can be quickly relocated from, for example, the front desk, to a office, by simply unplugging the control unit from one location and plugging it into the a/c wiring structure at the next location.

Figure 3:
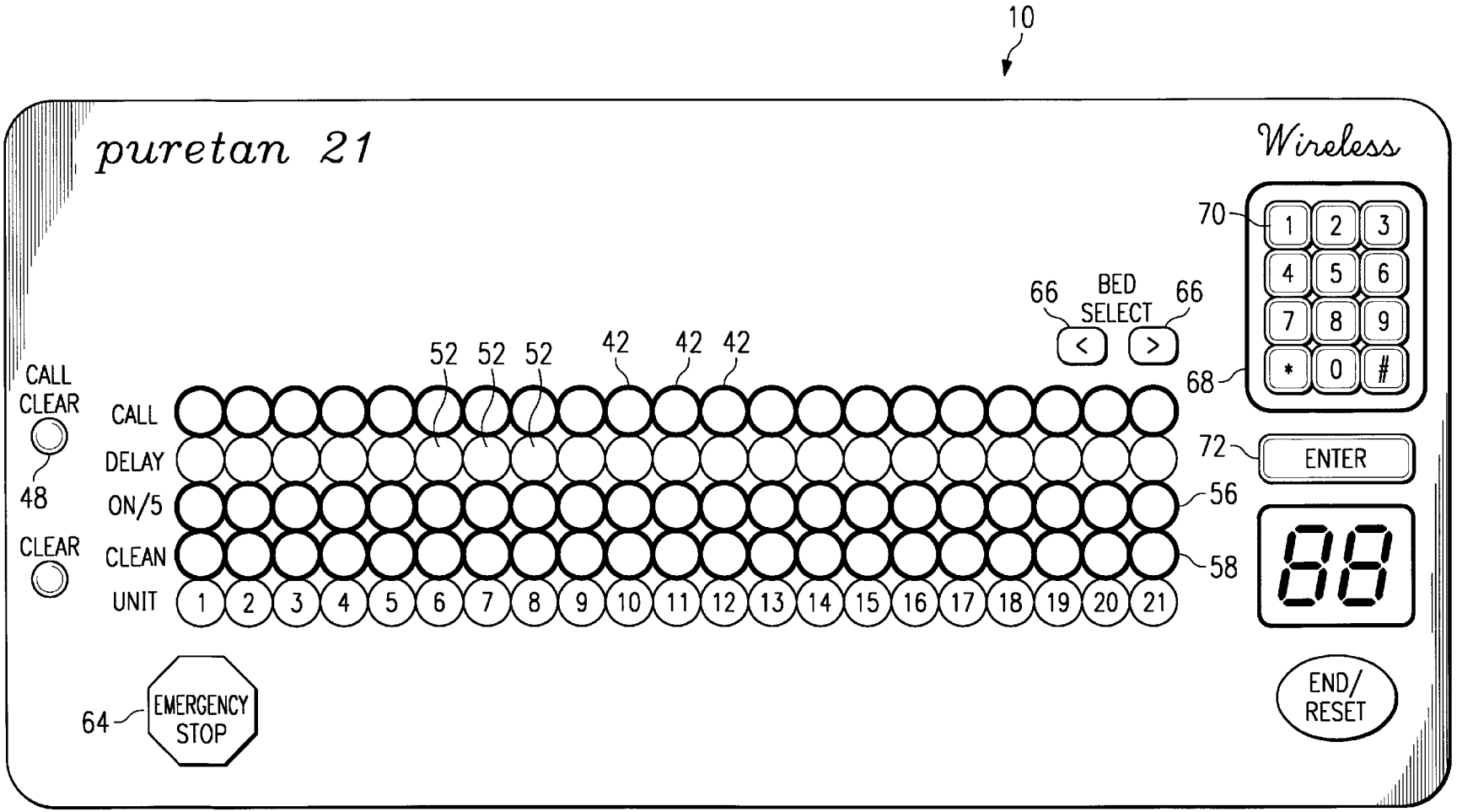
FIG. 3 is a front view of the control module of the tanning system.
Figure 4:
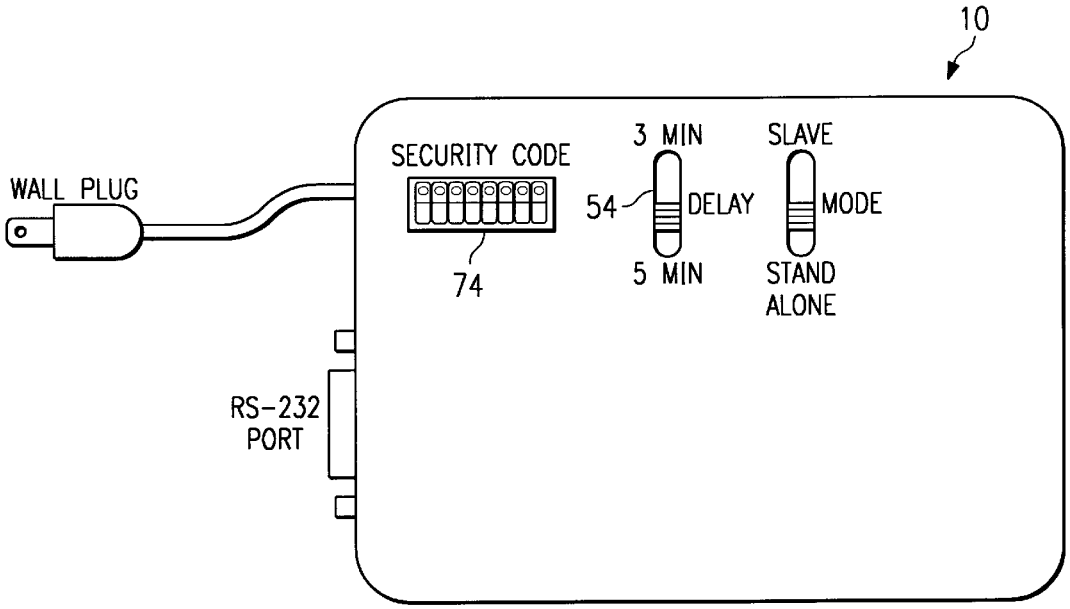
FIG. 4 is a rear view of the control module.
Figure 5:
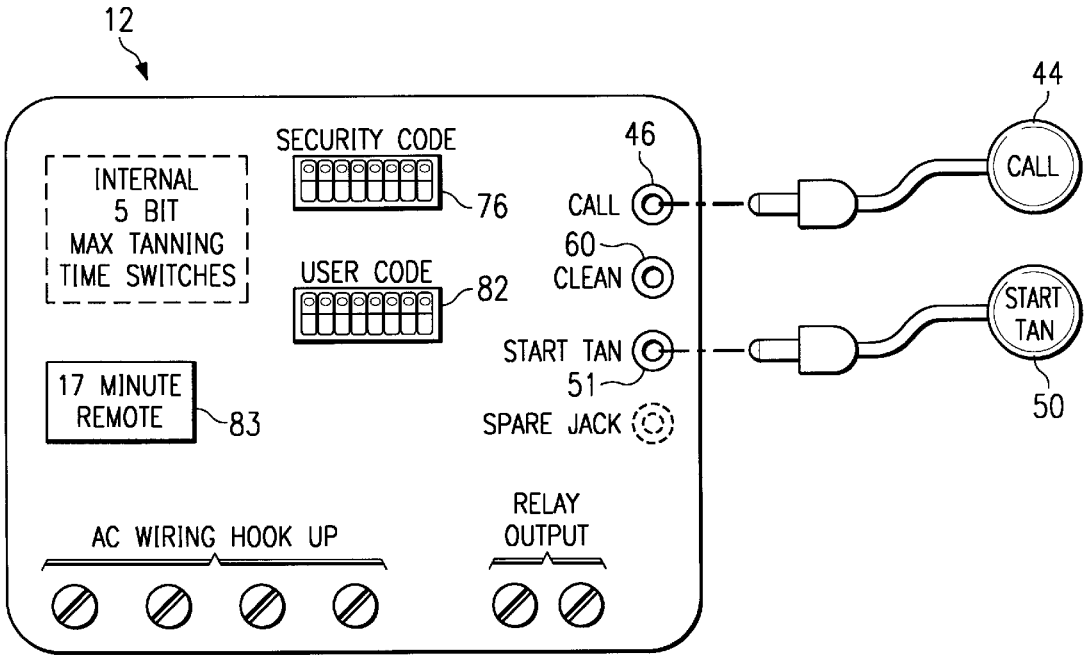
FIG. 5 is a front view of a remote module used in the tanning system.

With reference to FIGS. 3–5, a number of the features of the tanning system 14 will be described. The control unit 10 is illustrated as controlling twenty-one different tanning beds, numbered as units 1–21, respectively. However, it will be clear that any number of tanning beds may be controlled by the control unit as desired.

A row of call lights 42 are provided on the control unit 10 which will light when a customer requires assistance. As seen in FIG. 5, a remote call button 44 is plugged into a call jack 46 in the remote unit 12. When a customer wishes to attract the attention of the operator, the customer need only press the call button 44 which activates the user's specific call light 42 on the control unit 10 and, also preferably sounds a tone to draw the attention of the operator. As is clear from FIG. 3, the tanning bed from which the call button has been actuated can be readily read by the operator vertically below the lit call light. The call light 42 can be deactivated by the operator pressing a call clear button 48 on the control unit 10. If desired, a call light can also be mounted on the remote unit 12 to indicate to the customer that the customer has properly activated the call light function.

Many tanning salon controllers provide a delay time to allow the customer to get into the appropriate room and prepare for tanning prior to initiating the tanning session. These times are set at installation and usually range from 3 to 5 minutes. If the customer is ready earlier, the customer must wait for the delay time to finish before starting to tan. This results in wasted time for the customer, as well as for the salon as beds cannot be rotated out as fast as possible.

The present tanning system provides a start tan button 50 which plugs into plug 51 on the remote unit 12 which allows the customer to start the tanning interval prior to expiration of the normal delay time. When pressed by the customer, the control unit is informed that the tanning time may be started early, before the delay time has expired. A row of delay lights 52 on the control unit indicate that the controller is waiting for the delay time to end or the customer to push the start tan button. With reference to FIG. 4, a delay switch 54 can set the standard delay to 3 minutes or 5 minutes as desired. Clearly, the delay can be set at any interval desired and can, instead of a switch, be a infinitely variable interval setting between two limits.

The control unit also has a row of tanning/5-minute lights 56 to indicate that tanning is ongoing at a particular tanning bed. When 5 minutes or less of tanning time remains for the customer, the lights 56 begins flashing. The lights 56 therefore inform the operator not only that a tanning bed is in use, but also that it is near the end of its operating interval. This allows the operator to more efficiently schedule the tanning room operation.

The control unit 10 also includes a row of cleaning needed light 58 which light when a tanning session has been completed and the tanning bed needs to be cleaned. This light is automatically activated by the software within the tanning system 14 when a tanning session is complete. Each of the remote units 12 has a clean jack 60 for plugging in a switch to deactivate the cleaning needed light 58 for the associated tanning bed. The employee cleaning the bed will have the necessary switch. When the cleaning operation is completed, the employee will insert the switch in clean jack 60 and activate the switch to indicate to the operator that the tanning bed has been cleaned. Alternatively, a cleaned button 62 on the control unit 10 can be activated by the operator.

An emergency stop button 64 is mounted on the control unit 10 which will pause the tanning at every tanning bed immediately. Pressing the emergency stop button 64 a second time resumes the tanning at all tanning beds. During the pause, no tanning time is lost by the customer. The control unit 10 also provides for operations specific to each tanning bed. These operations include, for example, setting the time of the tanning session for a particular tanning bed. To operate an individual tanning bed, the operator must first select the particular tanning bed desired. This is done by pressing the bed select arrow keys 66 to move leftward or rightward on the display. The particular tanning bed selected will be lit on the bottom row of the control unit. A two-digit tanning time display 68 will display the tanning time remaining for the selected tanning bed. When the selected tanning bed is inactive, the display will show the maximum time allowable for that tanning bed. The maximum tanning time is automatically set at the control unit 10 by interaction with the remote unit 12 at that tanning bed. The tanning time may be changed in one-minute increments (or other increments as desired) using the up and down arrow keys near the display to match the tanning needs of the customer. A time cannot be incremented above the maximum time allowed for that tanning bed. A 10-numerical keypad 70 can be substituted for the up and down arrow keys.

A start button 72 is provided on the control unit 10. Pressing the start button will start the delay time on the selected tanning bed. After expiration of the delay time, or pushing the start button on the remote unit, the tanning session begins. By pressing the start button 72 a second time, the button acts as an end/reset button which stops the tanning on the selected tanning bed, turns on the cleaning needed light associated with the tanning bed and resets the tanning time.

In addition to the visual displays described above, the control unit 10 can be provided with a number of tones to draw the operator's attention. For example, different tones can be used to indicate that the tanning time has ended, that a call button has been pressed, that an attempt has been made to increment the tanning time to higher than the maximum tanning time for that tanning bed, and that the emergency button has been pressed.

A security code can also be input into the tanning system 14 by dip switches on the control unit 10 and remote units 12. For example, as seen in FIG. 4, the dip switch 74 allows entry of a security code. The same security code is then entered on dip switch 76 on each of the remote units 12. This is advantageous, particularly when using an X10 based system, to avoid interference from adjacent wireless information systems. The security code of each remote unit must be set to the same code as the control unit. If two or more wireless systems are used in the same area (i.e. to control twice the number of beds), different security codes must be chosen for each system.

As noted, each tanning bed will require only a single remote unit 12. The remote unit is installed into the tanning bed and attaches in parallel to all phases of a/c wiring in the a/c wiring structure 22. The remote unit 12 receives both the RF communication signal and power from the a/c wiring structure. It is necessary that the remote unit attach all phases of the incoming wiring to insure that the RF signal sent through any one of the phases will be received. The remote unit controls the tanning lamps in the tanning bed by activating a control relay through relay output 78. Terminals 80 are used to hook the remote unit 12 to the a/c wiring structure 22 for receiving power and signals from the control module 10, as well as sending signals to the control unit 10.

A dip switch 82 is mounted on each remote unit 12 to set in the numerical code which is to identify that particular remote unit on the display of the control unit 10. The unit number is set to correspond to the desired tanning bed number as it appears on the control unit face. It is preferable that each remote unit 12 be factory programmed for a specific maximum tanning time, for example between 1 and 31 minutes, and labeled with the selected maximum time as with label 83. The maximum tanning time provides an additional safety measure to insure that the proper tanning time for that tanning bed is not exceeded. Upon system initialization, the remote unit informs the control unit of its maximum tanning time. The controller unit uses the maximum tanning time value to serve as a starting value for the tanning time what appears on the tanning time display, as well as to provide a maximum tanning limit for that tanning bed.

Although a particular embodiment of the invention has been illustrated in the accompanying drawings and described in the foregoing detailed description, it will be understood that the invention is not limited to the embodiment disclosed, but is intended to embrace any alternatives, equivalents, and rearrangements or substitutions of elements as fall within the scope of the invention as defined by the following claims.

We claim:

1. A system for operating a plurality of tanning beds, each tanning bed connected to a common power line for powering the tanning bed, comprising:

a central controller connected to a PC computer;

a transmitting unit at the central controller connected to the common power line;

a plurality of receiving units, a selected one of said plurality of receiving units at a corresponding one of said plurality of tanning beds and connected to the common power line, the selected one of said plurality of receiving units having a unique code associated therewith permitting direct communications between said transmitting unit and the selected one of said plurality of receiving units;

said transmitting unit transmitting a series of control signals through the common power line to the selected one of said plurality of receiving units, the selected one of said plurality of receiving units controlling the corresponding one of said plurality of tanning beds in response to the control signals transmitted by said transmitting unit;

the selected one of said plurality of receiving units transmitting information regarding conditions at the corresponding one of said plurality of tanning beds to said transmitting unit, said transmitting unit receiving the information transmitted by the selected one of said plurality of receiving units and displaying the information transmitted on said PC computer connected to said central controller;

said central controller having a pause for transmitting a pause signal to the corresponding one of said plurality of tanning beds, having a time limit and thereafter transmitting a signal to the corresponding one of said plurality of tanning beds to turn off said tanning bed, having a delay time and thereafter transmitting a signal to the corresponding one of said plurality of tanning beds to turn on said tanning bed, and transmitting a clean signal to the corresponding one of said plurality of tanning beds when cleaning of said tanning bed is necessary after a tanning session;

the selected one of said plurality of receiving units having a programmed maximum time for indicating a maximum length of tanning time appropriate for the corresponding one of said plurality of tanning beds and for turning off said tanning bed after expiration of said maximum length of tanning time, having a customer operated call button for transmitting a call signal to the transmitting unit, having a customer operated start button for turning on the corresponding one of said plurality of tanning beds prior to expiration of said delay time, and having a done cleaning button for indicating that the corresponding one of said plurality of tanning beds has been cleaned;

wherein the common power line is a common alternating current power line which transmits electrical power to the corresponding one of said plurality of tanning beds, the central controller, the transmitting unit, and said plurality of receiving units and also transmits the direct communications between said transmitting unit and said plurality of receiving units.

* * * * *